US005140724A

United States Patent [19]

Crisanti

[11] Patent Number: 5,140,724

[45] Date of Patent: Aug. 25, 1992

[54] DOCUMENT AND FILE ORGANIZER

[76] Inventor: Joseph S. Crisanti, 16 Ladwood Dr., Holmdel, N.J. 07733

[21] Appl. No.: 516,176

[22] Filed: Apr. 30, 1990

[51] Int. Cl.[5] ..... B65D 63/00; B42F 21/00

[52] U.S. Cl. ..... 24/17 R; 24/17 A; 40/359; 229/72

[58] Field of Search ..... 24/17 R, 17 A; 40/359, 40/360, 641; 206/486, 444; 229/1.5, 72, 101

[56] References Cited

U.S. PATENT DOCUMENTS

| | | | |
|---|---|---|---|
| 137,000 | 3/1873 | Hunt . | |
| 216,543 | 6/1879 | Weaver . | |
| 299,323 | 5/1884 | Ball . | |
| 369,543 | 9/1887 | Matthews . | |
| 504,213 | 8/1893 | Goodwin et al. . | |
| 1,125,535 | 1/1915 | Hoffman | 229/72 |
| 1,333,102 | 3/1920 | Dietsche . | |
| 1,393,776 | 10/1921 | Harding | 229/72 |
| 1,463,296 | 7/1923 | Simon . | |
| 1,902,206 | 3/1933 | Wrigley . | |
| 1,926,359 | 9/1933 | Anthony | 24/17 A |
| 1,986,649 | 1/1935 | Steele . | |
| 2,037,839 | 4/1936 | Wagenseller | 229/101 |
| 2,202,268 | 5/1840 | Rohlfes . | |
| 2,267,106 | 12/1941 | Jellies . | |
| 2,299,697 | 10/1942 | Gruber . | |
| 2,537,732 | 1/1951 | Angus | 40/359 |
| 3,376,580 | 4/1968 | Ashmore . | |
| 3,933,294 | 1/1976 | Meenan et al. | 229/72 |
| 4,262,838 | 4/1981 | Mackenzie . | |
| 4,429,787 | 2/1984 | Morse | 229/72 |
| 4,653,639 | 3/1987 | Traynor | 206/444 |
| 4,759,495 | 7/1988 | Moon . | |

FOREIGN PATENT DOCUMENTS

| | | | |
|---|---|---|---|
| 2167043 | 5/1986 | United Kingdom | 229/101 |

*Primary Examiner*—Victor N. Sakran

[57] ABSTRACT

An adjustable document and file organizer is provided in the nature of an adjustable band which forms a continuous loop for securing a stack of such documents and files in an organized and secure manner. The band is formed in the nature of a flexible strip which may be die stamped or blanked from suitable materials such as stiff paper, cardboard, sheet plastic material and the like. The ends of the flexible strip are constructed and arranged to be cooperable with each other to provide relative sliding engagement therebetween to vary the girth of the band which is faciliated by a locking scale. The overlapping end portions are formed with cooperating elements in the nature of a locking tab and slits to prevent expansion of the organizer when in use. A plurality of score lines formed in the flexible strip allows for the convenient adjustment of the organizer to accommodate stacks of documents of varying thickness.

36 Claims, 3 Drawing Sheets

DOCUMENT AND FILE ORGANIZER

BACKGROUND OF THE INVENTION

The present invention relates in general to a document and file organizer, and more particularly, to an adjustable band of flexible material for selectively organizing in stacks or bundles various documents and files such as papers, stationery, envelopes, paper currency, stock certificates, bank notes, magazines, reports and the like.

A variety of systems and aids have been designed to store documents and files in protected environments which also facilitates their identification for retrieval when desired by the user. For example, file pockets and envelopes are known for transporting documents or for shelf filing. Documents are typically contained within these file pockets and envelopes either loosely or subdivided within file folders and jackets. These known systems and filing aids are designed for the storage of loose documents as opposed to organizing these documents in selected stacks as desired by the user. For example, within a given file folder or pocket it may be desired to retain groups of selected documents organized in one or more bundles which may be conveniently accessed for review without disturbing other selected documents within the same file folder or pocket.

There is known from U.S. Pat. No. 137,000 a band for holding small parcels such as packages of bank notes, piles of paper and the like. Bands for a similar purpose are known from U.S. Pat. Nos. 369,543, 299,323, 504,213, 216,543 and 2,299,697. In addition, there is also known bands for holding articles of clothing such as shirts from U.S. Pat. No. 1,986,649, transparent pie covers from U.S. Pat. No. 1,902,206 and preserving in predetermined confirmation a pile of small articles such as oranges and the like from U.S. Pat. No. 1,333,102. In general, each of these bands are constructed from an elongated strip of flexible material having means for securing same in the form of a continuous loop. Despite these numerous variations, there remains unknown a band which is conveniently adjustable to securely accommodate a stack of documents or files to be organized.

SUMMARY OF THE INVENTION

One object of the present invention is to provide a document and file organizer providing complete adjustability for accommodating stacks of documents, files and the like of various size.

Another object of the present invention is to provide a document and file organizer which is designed to simplify its use in conforming to a stack of documents or files, while at the same time, allowing easy access to individual items within the stack.

Another object of the present invention is to provide a document and file organizer which is designed to facilitate manipulation into assembled form from an unfolded blank.

Another object of the present invention is to provide a document and file organizer which can be mass produced economically from a single sheet of material by die stamping or blanking same in a continuous processing operation.

Another object of the present invention is to provide a document and file organizer which can be constructed from a variety of flexible materials.

In accordance with one embodiment of the present invention, there is provided an adjustable band constructed of a flexible strip having opposite end portions cooperable with each other when arranged in overlapping relationship to provide relative sliding engagement therebetween, the flexible strip arrangable into a closed loop of variable girth by changing the extent of the relative overlapping engagement between the opposite end portions, a first plurality of spaced apart score lines adjacent one opposite end portion and a second plurality of spaced apart score lines adjacent the other opposite end portion, whereby folding the flexible strip along the score lines within the first plurality and the second plurality varies the width of the closed loop.

In accordance with another embodiment of the present invention, there is provided an adjustable band constructed of a flexible strip having opposite end portions cooperable with each other when arranged in overlapping relationship to provide relative sliding engagement therebetween, the flexible strip is arrangable into a closed loop of variable girth by changing the extent of the relative overlapping engagement between the opposite end portions, and a pocket provided along a portion of the closed loop having an opening for receiving items to be retained within the pocket.

In accordance with another embodiment of the present invention, there is provided an adjustable band constructed of a flexible strip having opposite end portions cooperable with each other when arranged in overlapping relationship to provide relative sliding engagement therebetween, the flexible strip arrangable into a closed loop of variable girth by changing the extent of the relative overlapping engagement between the opposite end portions, and first means on one of the end portions and second means on the other of the end portions releasably engageable with each other when the end portions are arranged in overlapping relationship for preventing increasing the girth of the loop when the first and second means are engaged with each other while permitting decreasing the girth thereof.

In accordance with another embodiment of the present invention, there is provided an adjustable band constructed of a flexible strip having opposite end portions cooperable with each other when arranged in overlapping relationship to provide relative sliding engagement therebetween, one end portion including a first locking tab and the other end portion including a second locking tab, the flexible strip being arrangable into a closed loop of variable girth by changing the extent of the relative overlapping engagement between the opposite end portions, the one end portion including a first pair of parallel spaced apart slits and the other end portion including a second pair of parallel spaced apart slits, the first pair of parallel spaced apart slits engaged by the second locking tab and the second pair of parallel spaced apart slits engaged by the first locking tab, whereby the end portions are secured to each other in overlapping sliding relationship.

BRIEF DESCRIPTION OF THE DRAWINGS

The above description, as well as further objects, features and advantages of the present invention will be more fully understood with reference to the following detailed description of a document and file organizer, when taken in conjunction with the accompanying drawings, wherein.

DETAILED DESCRIPTION

Figure 1:
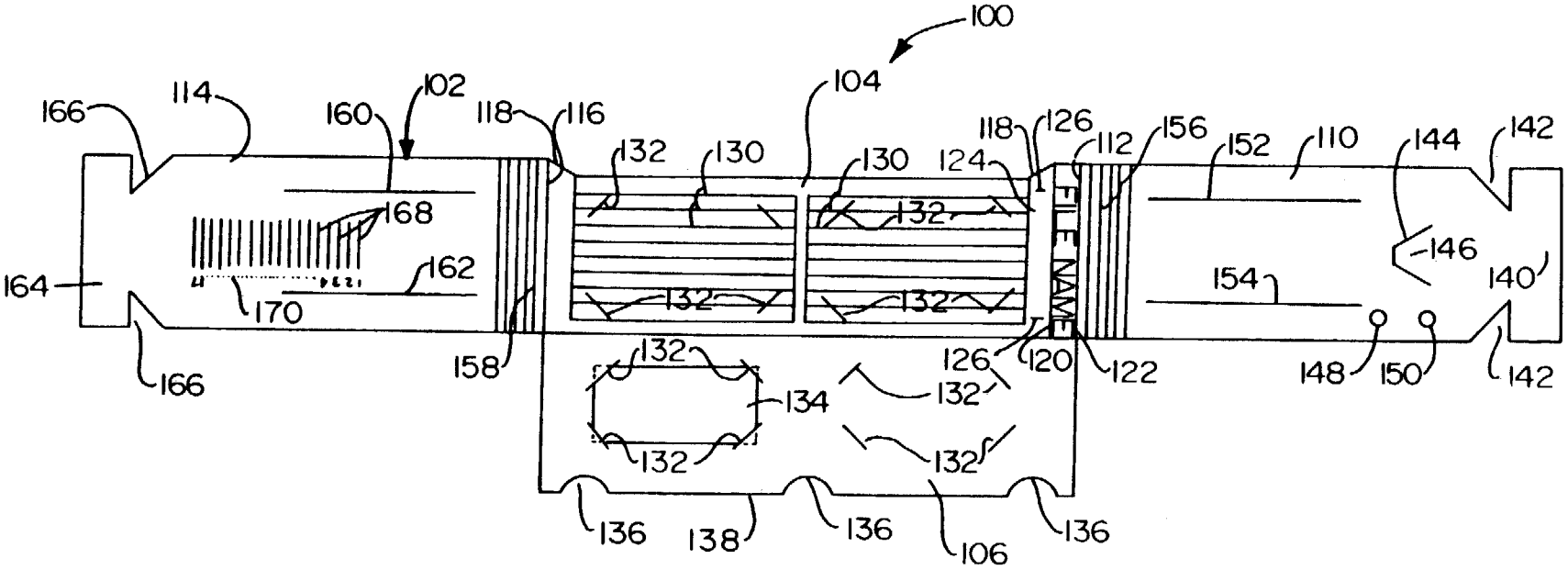
FIG. 1 is a top plan view of the document and file organizer of the present invention shown as an elongated strip in unfolded relationship as initially die stamped or from a continuous sheet of stock material.
Figure 2:
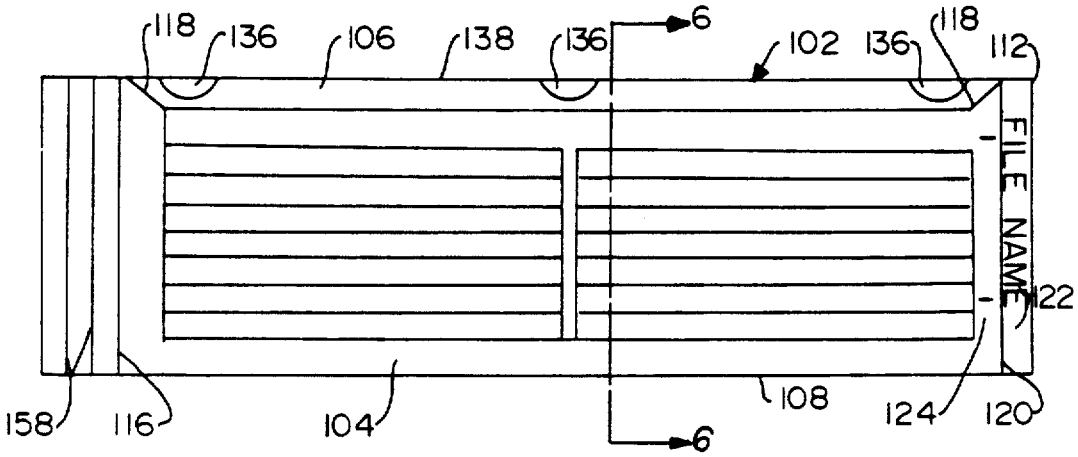
FIG. 2 is a front elevational view of the document and file organizer of the present invention showing the elongated strip of FIG. 1 folded into the form of an adjustable band.

Referring now to the drawings, wherein like reference numerals represent like elements, there is shown in FIG. 1 a document and file organizer in the nature of a band and generally designated by reference numeral 100. The band 100 is constructed from a flexible strip 102 which may be formed from a variety of materials such as stiff paper, cardboard, sheet plastic material and the like. The strip 102 includes four panels, namely, a center panel 104, a side panel 106 integrally joined to the center panel about fold line 108, a right end panel 110 integrally joined to the center panel about fold line 112 and a left end panel 114 integrally joined to the center panel about fold line 116.

The center panel 104 is constructed to have a height less than the height of the remaining panels 106, 110, 114 by virtue of inclined spaced apart edges 118. The right hand portion of the center panel 104 is provided with a transverse fold line 120 which divides this portion so as to define a blank label strip 122 for writing the file name as indicated and a tab strip 124 having a pair of spaced apart slits 126 to secure a file tab 128 (see FIG. 7) as to be described hereinafter. The major portion of the front surface of the center panel 104 is provided with printed indicia, such as lines 130 to accommodate written information. A plurality of slits 132 are arranged at an angle to one another in spaced apart rectangular relationship to secure a business card 134 thereto by engagement with the cards corners as shown on side panel 106 which is also provided with similar slits. Side panel 106 is further provided with a plurality of spaced apart finger recesses 136 in the nature of half circles formed along outer edge 138.

The free end of the right end panel 110 is formed as a rectangular shaped slide tab 140 by virtue of spaced apart V-shaped cutouts 142. Within the right end panel 110 there is provided a V-shaped slit 144 forming a locking tab 146, a pair of spaced apart openings 148, 150, a pair of longitudinally extending parallel spaced apart slits 152, 154 and a plurality of transverse parallel spaced apart score lines 156 arranged adjacent fold line 112.

Similarly, the left end panel 114 is provided with a plurality of transverse parallel spaced apart score lines 158 arranged adjacent fold line 116, a pair of longitudinally extending parallel spaced apart slits 160, 162 and a rectangular shaped slide tab 164 formed by spaced apart V-shaped cutouts 166. In addition, the left end panel 114 is provided with a plurality of transverse parallel spaced apart slits 168 arranged longitudinally between the slits 160, 162. Each of the slits 168 is identified by a number or the like which forms a locking scale 170 as to be described hereinafter. From the foregoing construction of the band 100, it should be appreciated that the flexible strip 102 can be formed from a single sheet of material using conventional known processing techniques such as die stamping, blanking and the like.

Referring now to FIGS. 2-6, the assembly and manipulation of the band 100 into the document and file organizer of the present invention, as well as the use of same for securing a bundle of papers in the form of documents, files and the like will now be described. With the band 100 laid flat, as shown in FIG. 1, the side panel 106 is folded rearwardly about fold line 108 and into a position underlying center panel 104. This arrangement creates a pocket 172 (see FIG. 6) between the side and center panels 104, 106 in which to store notes and other small materials. Left end panel 114 is folded about fold line 116 or about one of the score lines 158 into overlying relationship with the side panel 106. Similarly, the right end panel 110 is folded about fold line 112 or about one of the score lines 156 into overlying relationship with the left end panel 114. As will become apparent hereinafter, folding of the right end panel 110 about one of the score lines 156 and the left end panel 114 about one of the score lines 158 will effect the width of the band 100 so as to accommodate a stack of documents or files of varying thickness.

Figure 3:
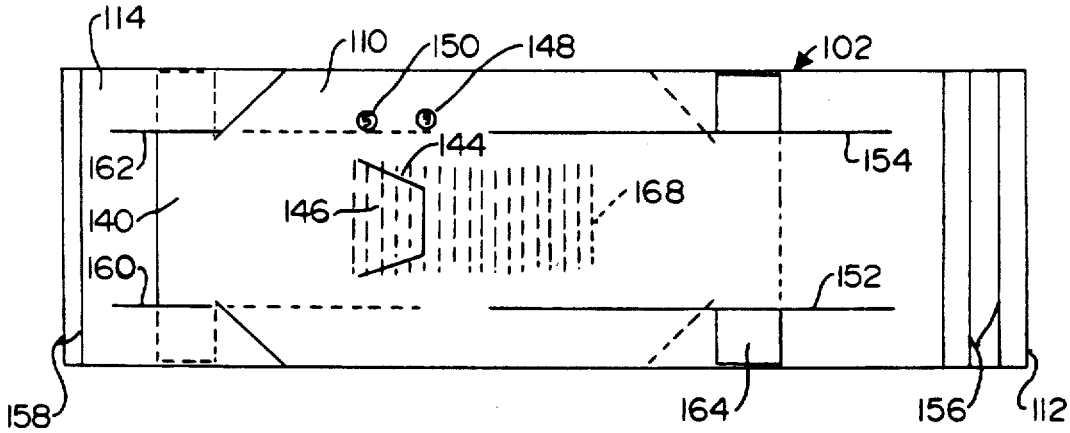
FIG. 3 thru 5 are rear elevational views of the document and file organizer shown in FIG. 2, showing components of the band being manipulated for securing the opposite end portions thereof into fixed overlapping relationship to prevent expansion of the band during use.
Figure 4:
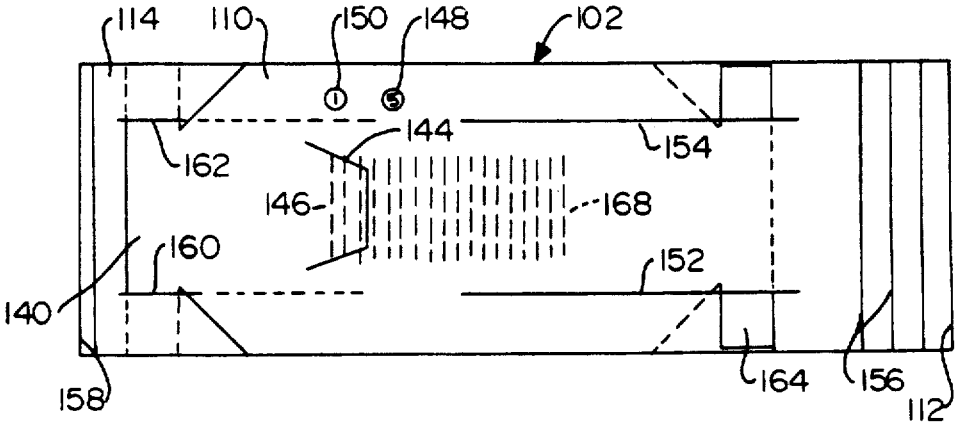

Referring now to FIG. 3, the right and left end panels 110, 114 are to be arranged in relative sliding engagement with each other such that the strip 102 can be formed into a closed loop of varying girth by changing the extent of the relative overlapping relationship between the right and left end panels. In this regard, the opposite ends of slide tab 140 are arranged extending through a respective slit 160, 162 and are then confined between the oppositely facing surfaces of the right and left end panels 110, 114 as shown in dashed lines. In a similar manner the center portion of the slide tab 164 of the left end panel 114 is disposed between the oppositely facing surfaces of the right and left end panels 110, 114 as shown in dashed lines and having its ends arranged extending through slits 152, 154 and overlying the outer surface of the right end panel. As a result of the respective engagement of the slid tabs 140, 164 with the slits 152, 154 and 160, 162 the right and left end panels 110, 114 are maintained in relative sliding engagement with each other.

Figure 6:
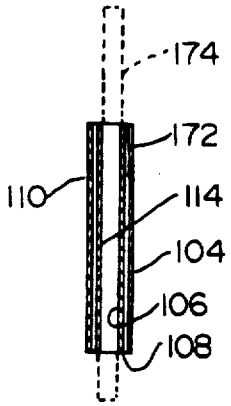
FIG. 6 is a cross-sectional view taken along line 6—6 in FIG. 2 showing the document and file organizer in use for securing a stack of documents or files as indicated by the dashed lines.

The band 100 is positioned about a stack of documents or files 174, as shown in FIG. 6, with the documents or files positioned between the inner surfaces of the side panel 106 and left end panel 114. The right and left end panels 110, 114 have been folded about fold lines 112, 116 or one of the score lines 156, 158 to accommodate the thickness of the stack of documents or files 174. The girth of the documents or files 174 is accommodated by the extent of relative sliding overlapping relationship between the right and left end panels 110, 114.

In securing the band 100 of appropriate girth in a locked condition, the right and left end panels 110, 114 are manipulated with respect to each other to provide a sliding fit over the documents or files 174. Upon achieving this condition, the numbers from the locking scale 170 appearing in the openings 148, 150 are noted. In the example shown, the number 5 appears in opening 150 while the number 9 appears in the opening 148. The band 100 is now removed from about the stack of documents or files 174 and the band is reduced in girth by pushing the right and left end panels 110, 114 longitudinally inwardly relative to one another until the number previously appearing in opening 150, i.e., number 5, now appears in opening 148, see FIG. 4. This manipulation of the right and left end panels 110, 114 may be facilitated by engaging the finger recesses 136 with the tips of ones fingers.

Figure 5:
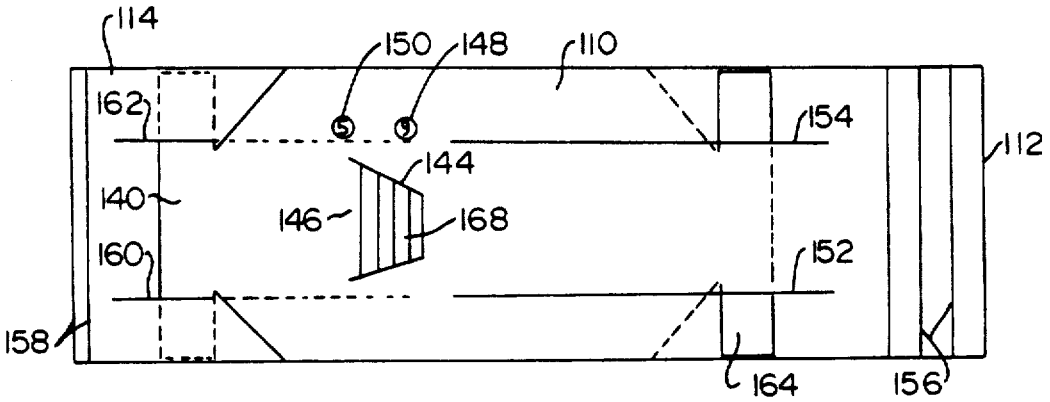

The tip of locking tab 146 is inserted through the closest aligned slit 168 formed in the underlying left end panel 114. The right and left end panels 110, 114 are now locked with respect to each other by pulling the end panels longitudinally outward relative to each other such that the tab 146 continues to be received through its inserted slot 168 until the slot reaches the extent of the side slits 144 forming the tab. Once this position is achieved, the right and left end panels 110, 114 are prevented from being further pulled longitudinally outward to increase the girth of the band 100. This condition is shown in FIG. 5 where the original numbers appearing in openings 148, 150 are the same as shown in FIG. 3, i.e., numbers 5 and 9, which correspond to the proper size of the band 100 for the girth of the stack of documents or files 174 to be secured. The band 100 being locked at its appropriate size may be placed over the stack of documents or files 174 to secure same as previously described.

In the event that additional documents or files 170 are added to the stack so as to increase its thickness, the band 100 may be suitably adjusted by folding about another of the score lines 156, 158 to accommodate the additional thickness, as well as readjustment of the tab 146 into a different slit 168 using the above procedure. In this regard, the right and left end panels 110, 114 may be longitudinally pushed inwardly relative to each other so that the locking tab 146 disengages from its received slot 168 thereby enabling the readjustment of the band 100.

The document and file organizer of the present invention thus provides the user the ability to quickly and easily organize documents and files which are arranged in groups of any thickness up to the capacity of the organizer. In support of the function of the document and file organizer, the organizer is provided with a pocket for holding notes, means for safely securing business cards, large areas for written indicia and end portions for file names and the like. Thus, it can be appreciated that the document and file organizer is versatile in use by having multiple applications.

Figure 7:
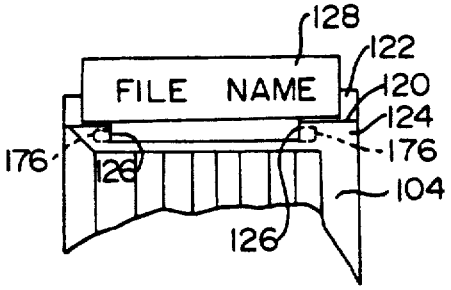
FIG. 7 is a partial front elevational view of one end of the document and file organizer showing the inclusion of a file tab.

Although the invention herein has been described with references to particular embodiments, it is to be understood that the embodiments are merely illustrative of the principles and application of the present invention. For example, as shown in FIG. 7, a file tab 128 having extensions 176 may be secured to the center panel 104 by engagement with slits 126 in the label strip 122. In this regard, the file tab 128 extends beyond the length of the band 100 to be readily visible by file name or other means when contained with other similar type materials. It is therefore to be understood that numerous modifications may be made to the embodiments and that other arrangements may be devised without departing from the spirit and scope of the present invention as defined by the claims.

What is claimed is:

1. An adjustable band for securing a stack of articles, said band comprising a flexible elongated strip having opposite end portions cooperable with each other when arranged in overlapping relationship to provide relative sliding engagement therebetween, said flexible strip arrangable into a continuous loop of variable girth by changing the extent of the relative overlapping engagement between said opposite end portions, said strip when arranged in said continuous loop positionable about a portion of said stack whereby individual articles are removable from said stack while said strip remains in said continuous loop, a first plurality of spaced apart score lines adjacent one opposite end portion and a second plurality of spaced apart score lines adjacent the other opposite end portion, whereby folding said flexible strip along said score lines within said first plurality and said second plurality varies the width of said closed loop to accommodate an increase or decrease in the size of said stack.

2. The adjustable band of claim 1, wherein one end portion includes a first slide tab slidingly engageable with the other end portion and said other end portion includes a second slide tab slidingly engageable with said one end portion.

3. The adjustable band of claim 2, wherein said one end portion includes a first pair of parallel spaced apart slits and said other end portion includes a second pair of parallel spaced apart slits, said first pair of parallel spaced apart slits engaged by said second slide tab and said second pair of parallel spaced apart slits engaged by said first slide locking tab, whereby said end portions are secured to each other in overlapping sliding relationship.

4. The adjustable band of claim 1, wherein said flexible strip includes a center panel arranged between said end portions and a side panel joined to said center panel about a fold line, said side panel foldable about said fold line to a position underlying said center panel to form a pocket therebetween.

5. The adjustable band of claim 4, wherein at least one of said center panel and said side panel includes a plurality of slits arranged to secure business cards thereto by receiving the corners thereof.

6. The adjustable band of claim 1, wherein said flexible strip includes a center panel joined between said opposite end portions about a respective fold line.

7. The adjustable band of claim 6, wherein said center panel includes a label strip at one end thereof to receive indicia.

8. The adjustable band of claim 6, wherein said center panel include a pair of slits arranged at one end thereof to secure a file tab thereto.

9. The adjustable band of claim 1, further including a plurality of parallel spaced apart slits arranged on one of said end portions, and a slide tab extendable from the other of said end portions and receivable through one of said slits.

10. The adjustable band of claim 9, further including locking scale means for allowing registration of said tab with a selected one of said slits to provide a predetermined girth of said band.

11. The adjustable band of claim 10, wherein said locking scale means includes a linear array of different indicia on said one of said end panels adjacent corresponding ones of said slits, and a pair of openings on said other of said end portions selectively registrationable with said indicia.

12. The adjustable band of claim 1, wherein said strip when arranged into said continuous loop has open sides.

13. An adjustable band comprising a flexible elongated strip having opposite end portions cooperable with each other when arranged in overlapping relationship to provide relative sliding engagement therebetween, said flexible elongated strip arrangable into a closed loop of variable girth by changing the extent of the relative overlapping engagement between said opposite end portions, and a side panel laterally joined to said strip and foldable overlying a portion of said strip to form a pocket therebetween, said pocket having an opening for receiving items to be retained within said pocket.

14. The adjustable band of claim 13, wherein one end portion includes a first slide tab slidingly engageable with the other end portion, and said other end portion includes a second slide tab slidingly engageable, with said one end portion.

15. The adjustable band of claim 14, wherein said one end portion includes a first pair of parallel spaced apart slits and said other end portion includes a second pair of parallel spaced apart slits, said first pair of spaced apart slits engaged by said second slide tab and said second pair o parallel spaced apart slits engaged by said first slide tab, whereby said end portions are secured to each other in overlapping sliding relationship.

16. The adjustable band of claim 13 wherein said flexible strip includes a center panel arranged between said end portions and a side panel joined to said center panel about a fold line, said side panel foldable about said fold line to a position underlying said center panel to form said pocket therebetween.

17. The adjustable band of claim 13, wherein said flexible strip includes a center panel joined between said opposite end portions about a respective fold line.

18. The adjustable band of claim 13, further including a plurality of parallel spaced apart slits arranged on one of said end portions, a slide tab extendable from the other of said end portions and receivable through one of said slits.

19. The adjustable band of claim 18, further including locking scale means for allowing registration of said tab with a selected one of said slits to provide a predetermined girth of said band.

20. The adjustable band of claim 19, wherein said locking scale means includes a linear array of different indicia on said one of said end panels adjacent corresponding ones of said slits, and a pair of openings on said other of said end portions selectively registrationable with said indicia.

21. An adjustable band comprising a flexible strip having opposite end portions cooperable with each other when arranged in overlapping relationship to provide relative sliding engagement therebetween, said flexible strip arrangable into a closed loop of variable girth by changing the extent of the relative overlapping engagement between said opposite end portions, and first means formed on one of said end portions and second means formed on the other of said end portions engageable with each other when said end portions are arranged in overlapping relationship for preventing increasing the girth of said loop by preventing sliding movement of said opposite end portions towards each other when said first and second means are engaged with each other while permitting decreasing the girth of said closed loop by permitting sliding movement of said opposite end portions away from each other.

22. The adjustable band of claim 21, wherein one end portion includes a first slide tab slidingly engageable with the other end portion, and said other end portion includes a second slide tab slidingly engageable with said one end portion.

23. The adjustable band of claim 22, wherein said one end portion includes a first pair of parallel spaced apart slits and said other end portion includes a second pair of parallel spaced apart slits, said first pair of spaced apart slits engaged by said second slide tab and said second pair of parallel spaced apart slits engaged by said first slide tab, whereby said end portions are secured to each other in overlapping sliding relationship.

24. The adjustable band of claim 21, wherein said first means comprises a plurality of parallel spaced apart slits arranged on one said end portions, and said second means comprises a slide tab extendable from the other of said end portions and receivable through one of said slits.

25. The adjustable band of claim 24, further including locking scale means for allowing registration of said tab with a selected one of said slits to provide a predetermined girth of said band.

26. The adjustable band of claim 25, wherein said locking scale means includes a linear array different indicia on said one of said end panels adjacent corresponding ones of said slits, and a pair of openings on said other of said end portions selectively registrationable with said indicia.

27. An adjustable band comprising a flexible strip having opposite end portions cooperable with each other when arranged in overlapping relationship to provide relative sliding engagement therebetween, one end portion including a first slide tab and the other end portion including a second slide tab, said flexible strip being arrangable into a closed loop of variable girth by changing the extent of the relative overlapping engagement between said opposite end portions, said one end portion including a first pair of parallel spaced apart slits and said other end portion including a second pair of parallel spaced apart slits, said first pair of parallel spaced apart slits engaged by said second slide tab and said second pair of slide tab, whereby said end portions are secured to each other in overlapping sliding relationship.

28. The adjustable band of claim 27, further including a plurality of parallel spaced apart slits arranged on one of said end portions, and a tab extendable from the other of said end portions and receivable through one of said slits.

29. The adjustable band of claim 28, further including locking scale means for allowing registration of said tab with a selected one of said slits to provide a predetermined girth of said band.

30. The adjustable band of claim 29, wherein said locking scale means includes a linear array of different indicia on said one of said end panels adjacent corresponding ones of said slits, and a pair of openings on said other of said end portions selectively registrationable with said indicia.

31. An adjustable band comprising a flexible strip having opposite end portions cooperable with each other when arranged in overlapping relationship to provide relative sliding engagement therebetween, said flexible strip arrangable into a closed loop of variable girth by changing the extent of the relative overlapping engagement between said opposite end portions, one opposite end portion including a first slide tab slidingly engageable with the other opposite end portion, said other opposite end portion including a second slide tab slidingly engageable with said one opposite end portion, a first plurality of spaced apart score lines adjacent one opposite end portion and a second plurality of spaced apart score lines adjacent the other opposite end portion, whereby folding said flexible strip along said score liens within said first plurality and said second plurality varies the width of said closed loop.

32. An adjustable band comprising a flexible strip having opposite end portions cooperable with each other when arranged in overlapping relationship to provide relative sliding engagement therebetween, said flexible strip arrangable into a closed loop of variable girth by changing the extent of the relative overlapping engagement between said opposite end portions, a first plurality of spaced apart score lines adjacent one opposite end and a second plurality of spaced apart score lines adjacent the other opposite end portion, whereby folding said flexible strip along said score lines within said first plurality and said second plurality varies the width of said closed loop, a plurality of parallel spaced apart slits arranged on one of said opposite end portions, a slide tab extendable from the other of said opposite end portions and receivable through one of said slits, and locking scale means for allowing registration of said tab with a selected one of said slits to provide a predetermined girth of said band.

33. An adjustable band comprising a flexible strip having opposite end portions cooperable with each other when arranged in overlapping relationship to provide relative sliding engagement therebetween, one opposite end portion including a first slide tab slidingly engageable with the other opposite end portion and said other opposite end portion including a second slide tab slidingly engageable with said one opposite end portion to form a closed loop, said flexible strip when arranged into said closed loop having a engaging means provided on said opposite end portions for maintaining said first and second slide tabs in engagement with said opposite end portions, variable girth by changing the extent of the relative overlapping engagement between said opposite end portions while said first and second slide tabs remain engaged with said engaging means.

34. An adjustable band comprising a flexible strip having opposite end portions cooperable with each other when arranged in overlapping relationship to provide relative sliding engagement therebetween, said flexible strip arrangable into a closed loop of variable girth by changing the extent of the relative overlapping engagement between said opposite end portions, therebeing a plurality of parallel spaced apart slits arranged on one of said opposite end portions, a slide tab extendable from the other of said opposite end portions and receivable through one of said slits, and locking scale means for allowing registration of said tab with a selected one of said slits to provide a predetermined girth of said band.

35. An adjustable band comprising a flexible strip having opposite end portions cooperable with each other when arranged in overlapping relationship to provide relative sliding engagement therebetween, said flexible strip arrangable into a closed loop of variable girth by changing the extent of the relative overlapping engagement between said opposite end portions, one end portion including a first slide tab slidingly engageable with the other opposite end portion, said other opposite end portion including a second slide tab slidingly engageable with said one opposite end portion, and first means on one of said end portions and second means on the other of said end portions engageable with each other when said end portions are arranged in overlapping relationship for preventing increasing the girth of said loop when said first and second means are engaged with each other while permitting decreasing the girth thereof.

36. An adjustable band comprising a flexible strip having opposite end portions cooperable with each other when arranged in overlapping relationship to provide relative sliding engagement therebetween, said flexible strip arrangable into a closed loop of variable girth by changing the extent of the relative overlapping engagement between said opposite end portions, first means on one of said end portions and second means on the other of said end portions engageable with each j other when said end portions are arranged in overlapping relationship for preventing increasing the girth of said loop when said first and second means are engaged with each other while permitting decreasing the girth thereof, said first means comprising a plurality of parallel spaced apart slits arranged on one of said end portions, said second means comprising a slide tab extendable from the other of said end portions and receivable through one of said slits, and locking scale means for allowing registration of said tab with a selected one of said slits to provide a predetermined girth of said band.

* * * * *

UNITED STATES PATENT AND TRADEMARK OFFICE

CERTIFICATE OF CORRECTION

PATENT NO. : 5,140,724

DATED : August 25, 1992

INVENTOR(S) : Joseph S. Crisanti

It is certified that error appears in the above-indentified patent and that said Letters Patent is hereby corrected as shown below:

Column 4, line 47, "slid" should read --slide--.
Column 6, line 31, cancel the word "locking".
Column 7, line 23, after "pair of" insert --parallel--.
Column 7, line 25, "pair o" should read --pair of--.
Column 8, line 16, "one said" should read --one of said--.
Column 8, line 25, after "array" insert --of--.
Column 9, line 8, "liens" should read --lines--.
Column 9, line 18, after "end" insert --portion--.
Column 9, line 37, after "loop" insert --engaging means provided on said opposite end portions for maintaining said first and second slide tabs in engagement with said opposite end portions--.
Column 10, line 36, after "each" cancel the letter "j".

Signed and Sealed this

Twenty-eighth Day of September, 1993

*Attest:*

*Attesting Officer*

BRUCE LEHMAN

*Commissioner of Patents and Trademarks*